US007079804B2

(12) United States Patent
Ando et al.

(10) Patent No.: US 7,079,804 B2
(45) Date of Patent: Jul. 18, 2006

(54) IMAGE FORMING APPARATUS

(75) Inventors: Hideki Ando, Hitachinaka (JP); Takasi Suzuki, Hitachinaka (JP); Masato Miwa, Hitachinaka (JP); Yoshitaka Fujinuma, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/855,366

(22) Filed: May 28, 2004

(65) Prior Publication Data

US 2004/0240917 A1 Dec. 2, 2004

(30) Foreign Application Priority Data

May 30, 2003 (JP) ..... 2003-154170
Feb. 27, 2004 (JP) ..... 2004-053089

(51) Int. Cl.
*G03G 15/00* (2006.01)

(52) U.S. Cl. ..... 399/400; 399/322; 399/397

(58) Field of Classification Search ..... 399/400, 399/324, 322, 397
See application file for complete search history.

(56) References Cited

U.S. PATENT DOCUMENTS 4,568,172 A * 2/1986 Acquaviva ..... 399/403
5,707,056 A * 1/1998 Rauen et al. ..... 271/96
6,032,008 A * 2/2000 Kolodziej ..... 399/167
6,169,874 B1 * 1/2001 Quesnel et al. ..... 399/400
6,477,339 B1 * 11/2002 Yano et al. ..... 399/66
6,661,989 B1 * 12/2003 Pitts et al. ..... 399/322
6,823,167 B1 * 11/2004 Gross et al. ..... 399/400
6,892,047 B1 * 5/2005 Giannetti et al. ..... 399/400
2002/0076228 A1 * 6/2002 Less et al. ..... 399/66

FOREIGN PATENT DOCUMENTS

JP 63-240577 10/1988
JP 02033175 A * 2/1990

* cited by examiner

*Primary Examiner*—Andrew H. Hirshfeld
*Assistant Examiner*—Dave A. Ghatt
(74) *Attorney, Agent, or Firm*—Antonelli, Terry, Stout and Kraus, LLP.

(57) ABSTRACT

To ensure stable feed of transfer material when a paper back vacuuming feed mechanism is employed in the path from a transfer section to a fixing section in an image forming apparatus, the image forming apparatus is such that the transfer section is arranged on the upper surface of the intermediate transfer unit; a transfer material feed apparatus is provided for vacuum feeding transfer material from the transfer section to the fixing apparatus; a guide tilted by a predetermined angle downward of the transfer material feed surface is provided at the outlet of the fixing apparatus of the transfer material feed apparatus; the nip portion of a fixing roller pair of the fixing apparatus is positioned downward of the extension line of the guide; and the tangent with respect to the nip portion of the fixing roller is tilted by a predetermined angle downward of the transfer material feed surface.

4 Claims, 4 Drawing Sheets

| α [°] | WRINKLES | | |
|---|---|---|---|
| | 64.0 g/m² FROM | 81.4 g/m² FROM | 104.7 g/m² FROM |
| 0 | PRESENT | PRESENT | ABSENT |
| 5 | ABSENT | ABSENT | ABSENT |
| 10 | ABSENT | ABSENT | ABSENT |
| 15 | ABSENT | ABSENT | ABSENT |
| 20 | ABSENT | ABSENT | ABSENT |
| 25 | ABSENT | ABSENT | ABSENT |
| 30 | ABSENT | ABSENT | ABSENT |
| 35 | PRESENT | ABSENT | ABSENT |
| 40 | PRESENT | ABSENT | ABSENT |
| 45 | PRESENT | ABSENT | ABSENT |
| 50 | PRESENT | PRESENT | ABSENT |

FIG. 6

| β [°] | IMAGE FLUCTUATION | | |
|---|---|---|---|
| | 54.0 g/m² FROM | 127.9 g/m² FROM | 209.3 g/m² FROM |
| 0 | ABSENT | PRESENT | PRESENT |
| 5 | ABSENT | PRESENT | PRESENT |
| 10 | ABSENT | PRESENT | PRESENT |
| 15 | ABSENT | ABSENT | PRESENT |
| 20 | ABSENT | ABSENT | ABSENT |
| 25 | ABSENT | ABSENT | ABSENT |
| 30 | ABSENT | ABSENT | ABSENT |
| 35 | ABSENT | ABSENT | ABSENT |
| 40 | ABSENT | ABSENT | ABSENT |
| 45 | PRESENT | PRESENT | PRESENT |
| 50 | PRESENT | PRESENT | PRESENT |

IMAGE FORMING APPARATUS

BACKGROUND OF THE INVENTION

The present invention relates to an image forming apparatus that operates on the basis of electrophotographic technology, such as a copying machine, a printer and a fax machine; and, more particularly, the invention relates to an image forming apparatus for obtaining a color image by superimposing multi-color toner images on an endless intermediate transfer belt.

One example of a known image forming apparatus using an intermediate transfer unit is a field sequential type image forming apparatus wherein, by repeating a series of processes which consist of forming a toner image on a photosensitive drum serving as a first image carrier and performing a primary transfer of this toner image on the intermediate transfer drum, four or five toner images are superimposed on the intermediate transfer drum, whereby multiplex image transfer is carried out. These steps are followed by secondary collective transfer of four or five toner images onto a transfer material, thereby obtaining a color image (or multicolor image) on the transfer material.

Such an image forming apparatus using an intermediate transfer unit is known to be capable of face-down stacking (sequential stacking with the recording surface facing downward), without the need for a special operation changing the paper position, wherein a paper back vacuuming type feed mechanism is used in the transfer material feed path (hereinafter referred to as "paper feed path") from a transfer section to a fixing section.

As shown in FIG. 4, the paper feed path, which extends from the feed section to the fixing section, is typically almost straight in the section which leads up to the image transferring stage. (For example, see the below-listed Patent Document 1). In FIG. 4, the apparatus includes an intermediate transfer belt 6, a secondary opposite transfer roller 6*a* over which the belt 6 passes, a secondary transfer roller 8, a fixing device 10, including a fixing roller lO*a*, a pressure roller 10*b* and a vacuum feed section 11.

Patent Document 1: Japanese Application Patent Laid-Open Publication No. Sho 63-240577

SUMMARY OF THE INVENTION

In the aforementioned apparatus, when thick transfer material is fed from a straight path to the fixing apparatus, the shock of the paper hitting the fixing apparatus is directly applied to the transfer section, with the result that the image fluctuates on the transfer material during the transfer step. This problem is particularly conspicuous in multi-color printing. Further, if the transfer material consists of thin paper, the stability of the transfer material cannot be maintained when the leading edge of the transfer material is detached from the vacuum feed section, because the vacuum feed section is not equipped with a guide for leading the paper. This is likely to cause wrinkles in the transfer material.

In view of the problems described above, it is an object of the present invention to ensure that there will be a stable feed of the transfer material when a paper back vacuuming feed mechanism is employed in the path from the transfer section to the fixing section in an image forming apparatus.

The foregoing object of the present invention can be achieved by an image forming apparatus which has a transfer section arranged over a transfer material feed path; a transfer material feed apparatus provided for vacuum transfer of a transfer material from the transfer section to a fixing apparatus; a guide tilted by a predetermined angle downward of the transfer material feed surface, which guide is provided at the outlet of the fixing apparatus of the transfer material feed apparatus, wherein the nip portion of a fixing roller pair of the fixing apparatus is positioned downward of the extension line of the guide; and the tangent with respect to the nip portion of the fixing roller is tilted by a predetermined angle downward of the transfer material feed surface of the transfer material feed apparatus.

BRIEF DESCRIPTION OF THE DRAWINGS

FIG. 6 is a table of data obtained in an experiment showing the relationship between the angle $\beta$ and image fluctuation in an embodiment of the present invention.

DETAILED DESCRIPTION OF THE INVENTION

Referring to FIGS. 1, 2, 3, 5 and 6, an embodiment of the present invention will be described.

Figure 1:
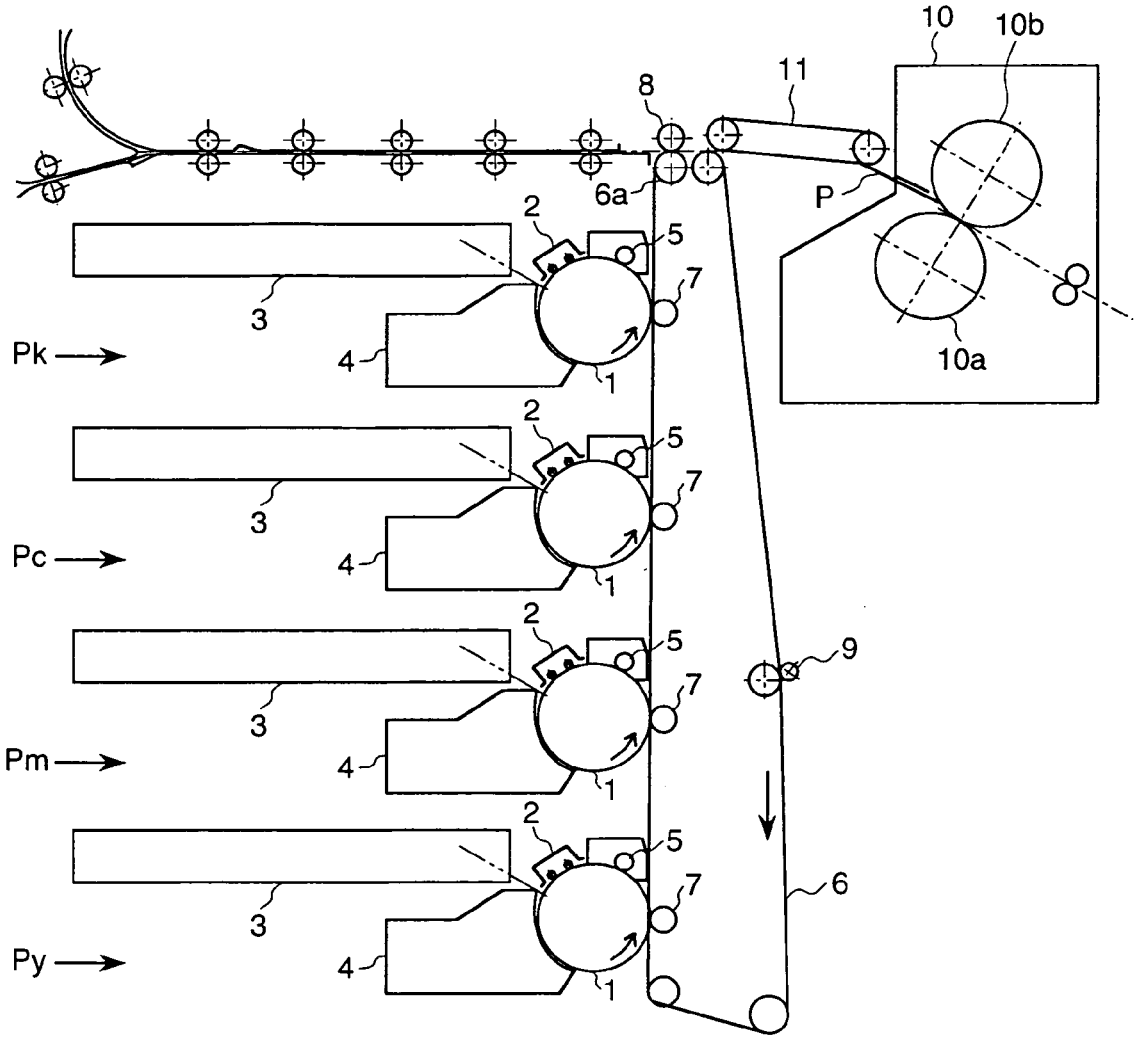
FIG. 1 is a diagrammatic cross sectional view of an image forming apparatus representing an embodiment of the present invention.

FIG. 1 is a diagrammatic cross sectional view representing a part of an image forming apparatus to which the present invention is applied. This image forming apparatus is a four-drum type image forming apparatus (in-line color type image forming apparatus) comprising four image forming sections each having a photosensitive drum 1 operating as a first image carrier. Toner images formed respectively on the photosensitive drums 1 of the image forming sections Py, Pm, Pc and Pk are superimposed on an intermediate transfer belt 6, which serves as a second image carrier, to perform multiple image transfer, and the resulting composite image is transferred onto the transfer material P that is fed to the intermediate transfer belt 6. An intermediate transfer unit for transferring a full-four color image on the transfer material P is incorporated in the image forming apparatus.

The intermediate transfer belt 6 is supported on a series of rollers and is rotated in the direction of the arrow by a driver roller 9. Four image forming sections Py, Pm, Pc and Pk are installed adjacent to the vertical path along the intermediate transfer belt 6 so as to be disposed in parallel to each other.

The image forming sections Py, Pm, Pc and Pk are basically designed to have the same configuration, and each has a photosensitive drum 1 serving as a first image carrier, a primary charging device 2, a laser exposure device 3, a developing device 4, a transfer roller 7 and a cleaner 5. The developing device 4 of each of the image forming sections Py, Pm, Pc and Pk contains one of yellow (Y), magenta (M), cyan (C) and black (K) developers.

During the rotation of the photosensitive drum 1, the first image forming section Py allows the surface of the photosensitive drum 1 to be uniformly charged by the primary charging device 2 so as to have a predetermined polarity and potential. Then, the surface is exposed by the exposure device 3 (an optical exposure system for color decomposition and image formation of a color document image, a scanning exposure system by laser scanning that produces laser beams modulated in response to the time series digital pixel signal of image formation, or others), whereby an electrostatic latent image corresponding to the first color component (yellow component) of the color image is formed on the surface of the photosensitive drum 1. Then the electrostatic latent image is developed by the developing device 4, using a yellow developer, and is turned into a visible image as a yellow toner image. The yellow toner image formed on the photosensitive drum 1 proceeds to enter the primary transfer nip portion opposite the intermediate transfer belt 6. The transfer roller 7 is arranged on the back of the intermediate transfer belt 6 of the primary transfer nip portion and is held in engagement on the downstream side inside the transfer nip portion. The yellow toner image on the photosensitive drum 1 is primarily transferred onto the intermediate transfer belt 6 when primary transfer bias is applied to the transfer roller 7 from a primary transfer power supply (not illustrated). To ensure that the primary transfer bias can be applied independently to the transfer roller 7 of each of the image forming sections Py, Pm, Pc and Pk, a respective primary transfer power supply is provided independently for each image forming section.

In a manner similar to the above, a magenta toner image, a cyan toner image and a black toner image are formed by the second, third and fourth image forming sections Pm, Pc and Pk, and a color image obtained by superimposing the four color toner images of yellow, magenta, cyan and black is formed on the intermediate transfer belt 6.

Where the secondary opposite transfer roller 6*a* of the intermediate transfer belt 6 is located, a secondary transfer roller 8 is installed on the outer surface side of the intermediate transfer belt 6, where a secondary transfer section is formed. The full color image that is carried on the intermediate transfer belt 6 collectively undergoes secondary transfer onto the transfer material P, that is supplied to the secondary transfer section of the intermediate transfer belt 6 from the paper feed section (not illustrated), by means of the transfer roller 8. Then, the transfer material P, which has received the image by secondary transfer, is transported to the fixing device 10, where heat and pressure are applied to the four-color toner, so that the transfer material P is fused and fixed. Thus, a color print image is obtained.

Subsequent to the secondary image transfer, the intermediate transfer belt 6 is cleaned by means of a belt cleaner in such a way that the toner remaining on the surface thereof after the secondary image transfer is removed to ensure that the next image formation can be started at any time. After the aforementioned primary transfer, the photosensitive drum 1 of each image forming section is cleaned by the drum cleaner 5 in such a way that the toner remaining on the surface after primary image transfer is removed to ensure that the next image formation can be started at any time.

Figure 2:
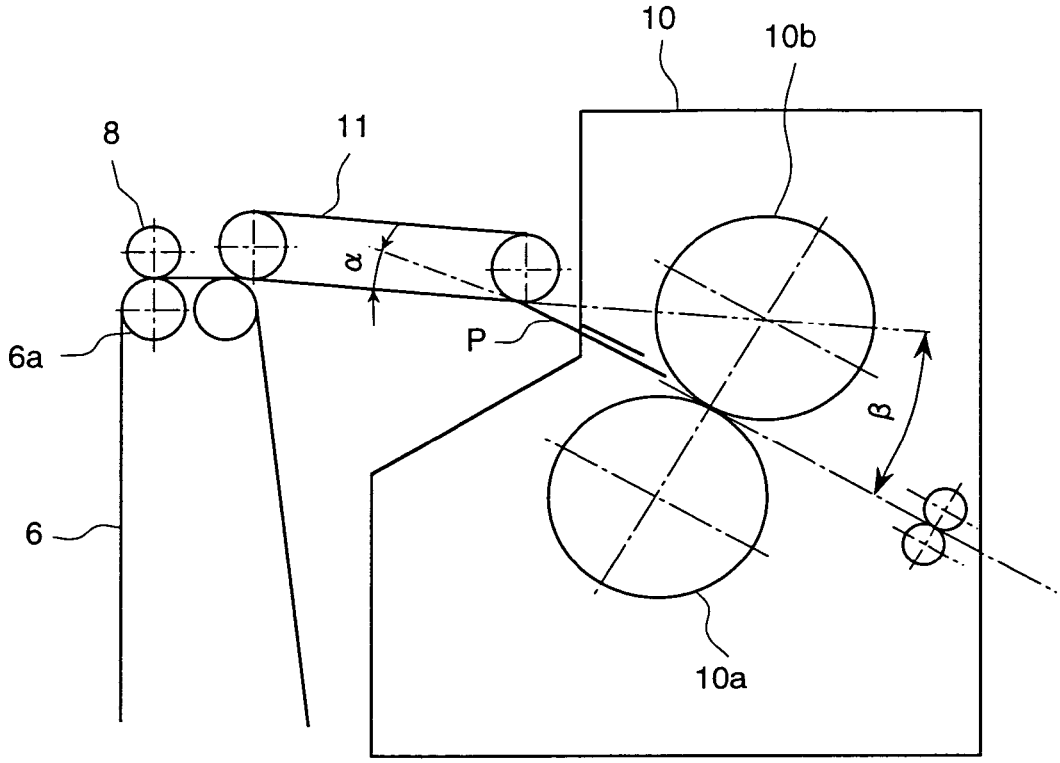
FIG. 2 is a diagram showing the portion of the image forming apparatus from the transfer section to the fixing section in the embodiment of the present invention shown in FIG. 1.
Figure 3:
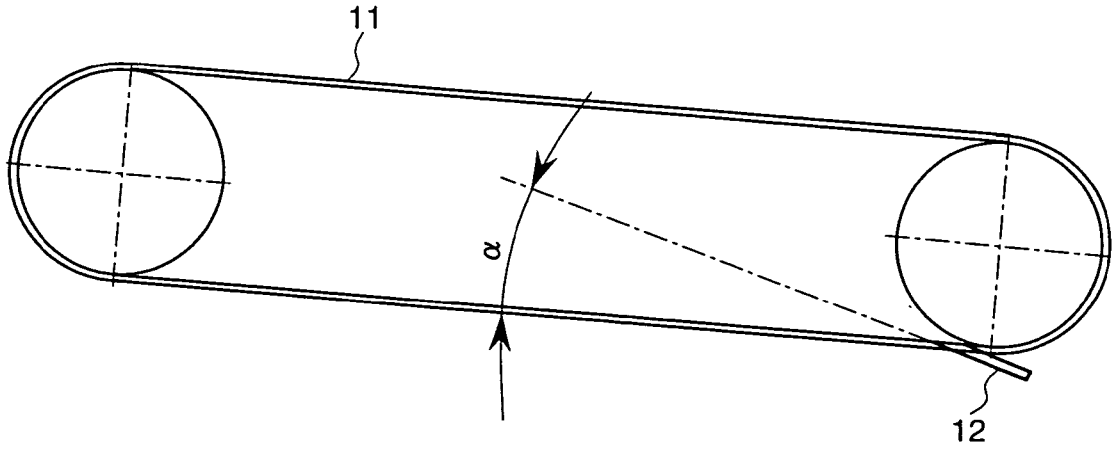
FIG. 3 is a diagram showing a vacuum feed section in the embodiment of the present invention.
Figures 4, 5:
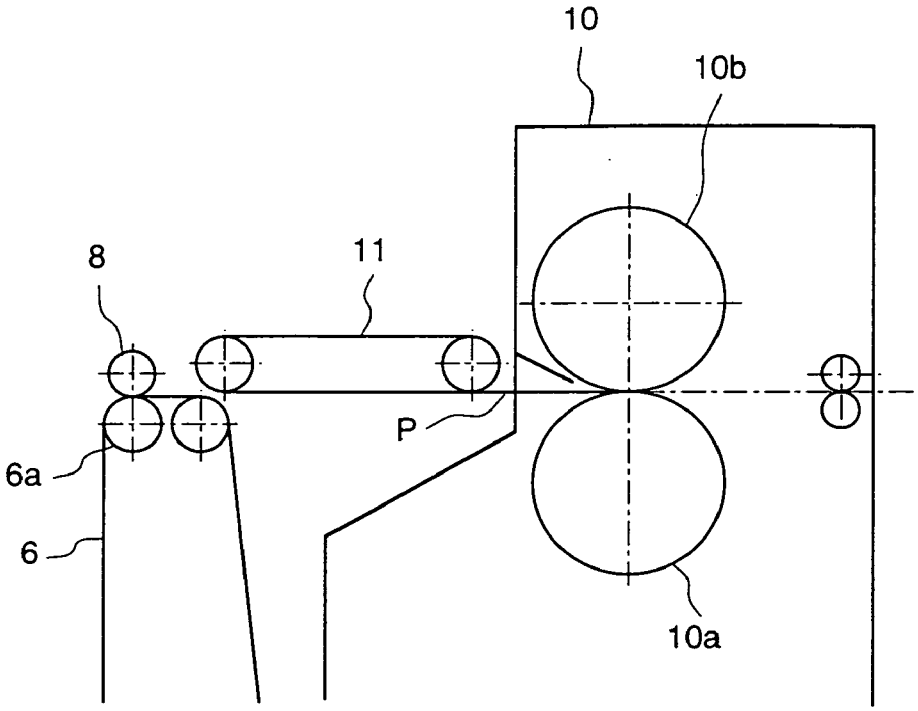
FIG. 4 is a diagram showing the portion from the transfer section to the fixing section in a known image forming apparatus.
FIG. 5 is a table of data obtained in an experiment data showing the relationship between the angle $\alpha$ and paper wrinkles in an embodiment of the present invention.

FIGS. 2 and 3 are enlarged views of the characteristic portions of the image forming apparatus of the present invention. In these figures, a paper back vacuuming system is employed in the vacuum feed section 11 to feed transfer material P to the fixing device 10 after toner has been transferred onto the transfer material P from the intermediate transfer belt 6. In this arrangement, a guide 12, which is tilted by the angle $\alpha$ in a downward direction, is provided at the outlet of the paper feed path so that the transfer material P can be moved downward, and the nip portion of a fixing roller pair of the fixing apparatus is positioned downward of the extension line of the guide 12, where the tangent with respect to the nip portion of the fixing roller is tilted by the angle $\beta$. When thin paper is used as the transfer material, this configuration enables stable detachment of the leading edge of the paper from the vacuum feed section by means of the guide having an angle of $\alpha$ provided at the path outlet, thereby preventing wrinkles from being produced in the paper. When thick paper is used as the transfer material, the shock caused by the paper hitting against the fixing section can be reduced by the angle $\beta$ in the tangential direction up to the fixing roller, whereby image fluctuation can be prevented. To examine the affect of the angle $\alpha$, an experiment was conducted on three types of paper which were different in ream weight, as shown in FIG. 5. As a result of this experiment, it was revealed that wrinkles in the three types of paper are reduced in at least the range from 5 through 30 degrees. Further, in order to check the affect of the angle $\beta$, the result of the experiment has shown that image fluctuation of the three types of paper can be reduced at least in the range from 20 through 40 degrees, as shown in FIG. 6.

As described above, the present invention avoids the formation of wrinkles in thin paper and fluctuation of an image caused by the use of thick paper during paper feed by a back vacuuming mechanism.

What is claimed is:

1. An image forming apparatus comprising:

means for superimposing toner images of various colors formed respectively by multiple image carriers on an intermediate transfer unit in sequence;

means for transferring the superimposed toner images onto a transfer material using a transfer section;

a fixing apparatus for fixing the toner on said transfer material; and means for ejecting said transfer material to the side of the main unit of the apparatus;

said transfer section being arranged on the upper surface of said intermediate transfer unit;

a transfer material feed apparatus being provided for vacuum feeding of the transfer material from said transfer section to said fixing apparatus;

a guide tilted by a predetermined angle downward of the transfer material feed surface, where said guide is provided at the outlet of said fixing apparatus of the transfer material feed apparatus and is arranged between the vacuum feed belts of said transfer material feed apparatus;

the nip portion of a fixing roller pair of said fixing apparatus is positioned downward of the extension line of said guide; and the tangent with respect to the nip portion of the fixing roller is tilted by a predetermined angle downward of the transfer material feed surface of said transfer material feed apparatus.

2. The image forming apparatus of claim 1, wherein the tilt angle of said guide is in the range from 5 through 30 degrees.

3. The image forming apparatus of claim 1, wherein the tilt angle of said tangent line is in the range from 20 through 40 degrees.

4. The image forming apparatus of claim 1, wherein the intermediate transfer unit includes a vertically movable belt carrier arranged to move with respect to a vertical arrangement of said multiple image carriers so as to superimpose in sequence the toner images of various colors thereon, and said transfer section being disposed at a position above said vertically movable belt carrier.

* * * * *